US008888468B2

(12) United States Patent
Maganhoto et al.

(10) Patent No.: US 8,888,468 B2
(45) Date of Patent: Nov. 18, 2014

(54) MOUNTING ARRANGEMENT OF THE SUSPENSION SPRINGS IN A REFRIGERATION COMPRESSOR

(75) Inventors: Sergio Luiz Maganhoto, Joinville-Sc (BR); Joao Manoel Mendes, Joinville-Sc (BR); Ticiano Bitencourt Campos, Joinville-Sc (BR)

(73) Assignee: Whirlpool S.A., São Paulo -SP (BR)

( * ) Notice: Subject to any disclaimer, the term of this patent is extended or adjusted under 35 U.S.C. 154(b) by 392 days.

(21) Appl. No.: 13/504,032

(22) PCT Filed: Oct. 15, 2010

(86) PCT No.: PCT/BR2010/000351

§ 371 (c)(1), (2), (4) Date: Jul. 11, 2012

(87) PCT Pub. No.: WO2011/050430

PCT Pub. Date: May 5, 2011

(65) Prior Publication Data

US 2012/0269661 A1 Oct. 25, 2012

(30) Foreign Application Priority Data

Oct. 27, 2009 (BR) ..... 0904172

(51) Int. Cl.

| | |
|---|---|
| ***F04B 39/14*** | (2006.01) |
| ***F04B 39/12*** | (2006.01) |
| ***F04B 39/00*** | (2006.01) |

(52) U.S. Cl.

CPC ..... *F04B 39/0044* (2013.01); *F04B 39/127* (2013.01)

USPC ..... 417/363

(58) Field of Classification Search

CPC ..... F04B 39/127; F04B 39/0044

USPC ..... 417/363, 902

See application file for complete search history.

(56) References Cited

U.S. PATENT DOCUMENTS

| | | | | | |
|---|---|---|---|---|---|
| 2,130,835 | A | * | 9/1938 | Bixler | 417/363 |
| 2,222,724 | A | | 11/1940 | Rogers | |
| 2,801,045 | A | * | 7/1957 | Philipp | 417/363 |
| 3,030,056 | A | | 4/1962 | Rogers | |
| 3,169,696 | A | * | 2/1965 | Warner | 417/372 |
| 3,315,880 | A | * | 4/1967 | Kropiwnicki | 417/428 |
| 3,531,069 | A | | 9/1970 | Dubberley | |
| 3,836,290 | A | * | 9/1974 | Carter | 417/415 |
| 6,004,113 | A | | 12/1999 | Vay | |

* cited by examiner

*Primary Examiner* — Bryan Lettman

(74) *Attorney, Agent, or Firm* — Gifford, Krass, Sprinkle, Anderson & Citkowski, P.C.

(57) ABSTRACT

A suspension spring mounting arrangement applied to a refrigeration compressor comprising a shell (1) and a block (3) forming, with the stator (4) of an electric motor, a stationary assembly (2) mounted inside the shell (1) by an assembly of helical springs (10), each spring presenting a lower end (11) and an upper end (12), each end (11, 12) being coupled, respectively, to an adjacent part of the shell (1) and the stationary assembly (2), through a support (MS). The support (MS) comprises a base plate (20) incorporating at least two retention tongues (21) obtained from a portion of the base plate (20) which is bent to project outwardly from the plane of the latter, so that the retention tongues (21) are tightly fitted in the interior of one of the ends (11, 12) of an adjacent helical spring (10).

11 Claims, 9 Drawing Sheets

MOUNTING ARRANGEMENT OF THE SUSPENSION SPRINGS IN A REFRIGERATION COMPRESSOR

FIELD OF THE INVENTION

The present invention refers to a constructive arrangement to provide the mounting of the suspension springs used in a refrigeration compressor of the type which presents its motor-compressor assembly vertically mounted and maintained suspended in the interior of the compressor shell by means of helical springs operating under compression.

PRIOR ART

Refrigeration compressors with a vertical shaft are conventionally provided with a spring suspension system, for isolating the vibrations of the motor-compressor assembly in relation to the compressor shell, for limiting the movements of the motor-compressor assembly at the start and stop and for supporting the motor-compressor assembly during shipping. The vibrations generated during the normal operation are produced by the oscillation of the movable mass of the motor-compressor assembly, said movable mass usually comprising a piston, a connecting rod, and a crankshaft carrying the rotor of an electric motor.

The suspension systems of the motor-compressor assembly for refrigeration compressors can be divided into two groups: dampening with the use of suspension springs and dampening with the use of compression springs.

In the constructive arrangement using compression springs, generally of the helical type, as illustrated in FIGS. 1, 1A, 2, 2A and 2B, these are anchored, inferiorly, to a support means MS attached to a bottom portion 1*a* (FIGS. 1 and 1A) or to a lateral portion 1*b* (FIGS. 2, 2A and 2B) of the shell 1 of the compressor, in the interior of said shell 1 and, superiorly, under a support means MS attached to a stationary assembly 2 formed by the usual block 3 of the compressor and by the stator 4 of the respective electric motor.

A technique for anchoring the helical compression springs 10 to the shell 1 and/or to the stationary assembly 2 of the compressor uses support means MS comprising a base plate 20 to which is attached, by welding or other adequate fixation means, a respective pin 30. Each pin 30 can be constituted by a machined pin 31 or a stamped tubular pin 32, to be affixed to said base plate 20. For anchoring the helical spring 10 to each support means MS affixed in the shell 1 or in the stationary assembly 2 of the compressor, each pin 30 receives and retains, onto itself, a cover 40, generally made of a synthetic material, such as plastic or rubber for covering said pin 30 and which is configured to be tightly fitted in the interior of the adjacent end of a respective helical spring 10 (FIGS. 1 and 2).

The typical systems for anchoring helical suspension springs 10 of the stationary block-stator assembly in the interior of the shell 1 of refrigeration compressors, by using stamped pins 32 or machined pins 31 affixed to the base plate 20 of the respective support means MS, present drawbacks, such as high cost as a function of the construction of stamped (or spun) pins 32, as well as the need of attaching the pin 30, in the form of a separate piece, to the base plate 20 of each support means MS. In these known solutions, there is a certain undesirable amount of component parts which require a corresponding amount of material and mutual fixation operations for the formation of each support means MS.

Another inconvenience of the constructions mentioned above results from the existence of fixation regions between the component parts of each support means MS, said fixation regions being constituted by regions susceptible to breaks during the useful life of the compressor, disconnecting the pins 30 of the respective base plates 20 and destroying the anchorage of the adjacent end 11, 12 of the respective helical spring 10. The constructions cited above, according to which each end 11, 12 of the helical spring 10 is anchored around a single pin 30, which can be a stamped pin 32 or a machined pin 31, present the inconvenience of requiring the pins 30 to be covered by the cover 40 for providing a tight anchorage of the end 11, 12 of the helical spring 10 in each support means MS. The construction of a single pin 30 for anchoring each end 11, 12 of the helical spring 10 requires special and costly cares, so that the pin 30 presents a shape which is perfectly adapted to the inner volume of each end 11, 12 of the helical spring 10. Nevertheless, the provision of the cover 40 raises the price of the construction and of the mounting process of the compressor, since it requires an additional piece and a respective operation for mounting said piece on the pin 30.

SUMMARY OF THE INVENTION

As a function of the inconveniences mentioned above, it is a generic object of the present invention to provide a mounting arrangement of the suspension springs in a refrigeration compressor, which requires a lower number of pieces and less material for the formation of each support means, simplifying the manufacturing and mounting operations of each support means, reducing its cost and providing a stronger suspension with a lower risk of breaking during the useful life of the compressor.

These objects are attained through a mounting arrangement of the suspension springs in a refrigeration compressor of the type which comprises: a shell and a block forming, with the stator of an electric motor, a stationary assembly which is mounted in the interior of the shell by means of a suspension including an assembly of helical springs, each spring presenting a lower end and an upper end, each end being coupled, respectively, to an adjacent part of shell and stationary assembly, through a support means.

According to the invention, the support means comprises a base plate incorporating, in a single piece, at least two retention tongues obtained from a portion of said base plate which is bent so as to project outwardly from the plane of said base plate, said retention tongues being tightly fitted in the interior of one of the ends of an adjacent helical spring.

The construction proposed by the invention and defined above allows each end of a helical suspension spring to be anchored directly around two or more projecting tongues, which are obtained by simply cutting out and bending a portion of the base plate. Said tongues can have their shaping and relative positioning easily adjusted so as to be precisely and tightly fitted in the interior of the adjacent end of a respective helical suspension spring, making unnecessary the provision of the plastic cover and substantially simplifying the construction and assembly of said support means.

BRIEF DESCRIPTION OF THE DRAWINGS

The invention will be described below, with reference to the enclosed drawings in which.

DESCRIPTION OF THE ILLUSTRATED EMBODIMENTS

Figure 1:
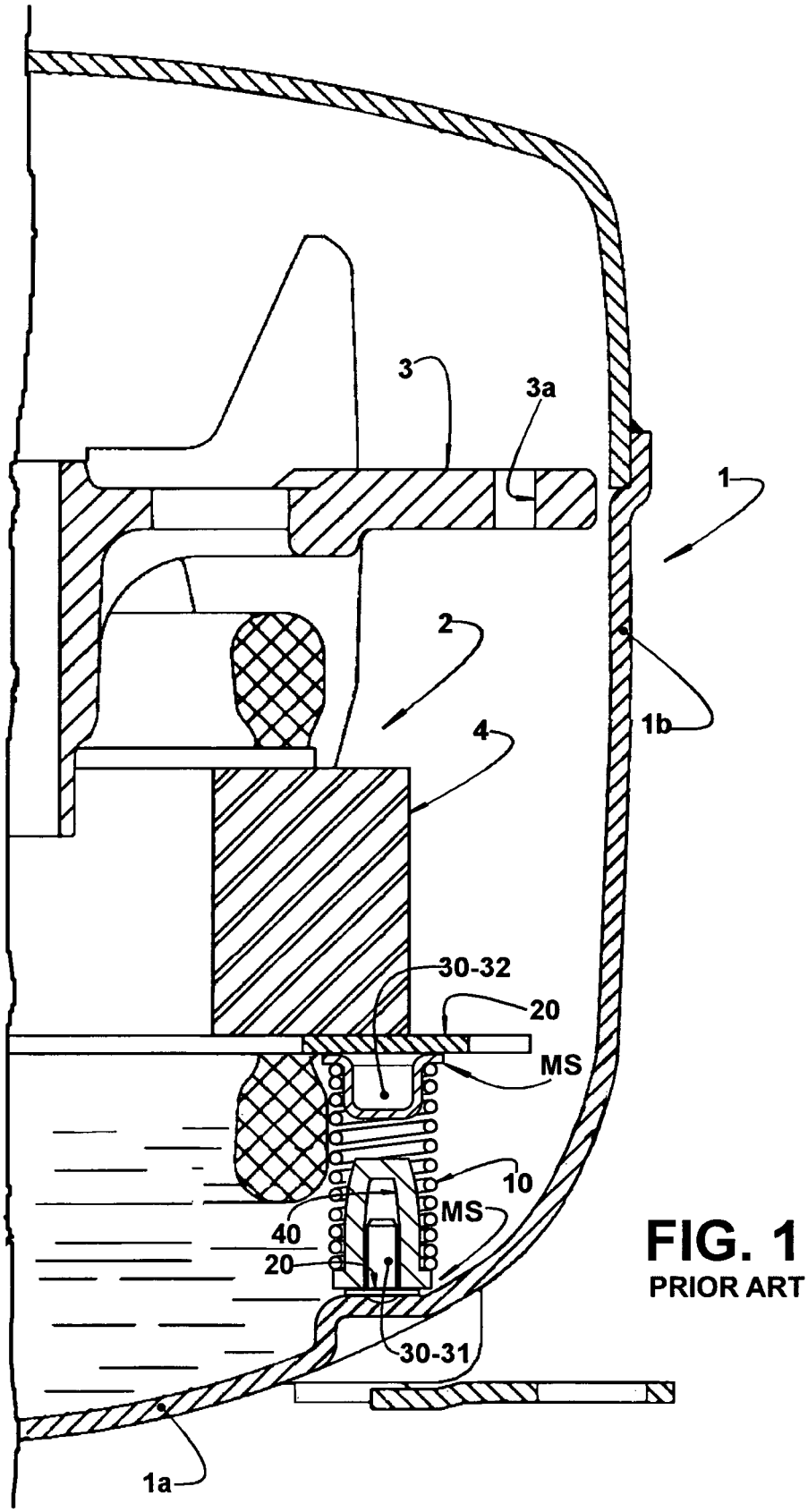
FIG. 1 PRIOR ART
FIG. 1 represents a schematic vertical sectional view of a portion of a refrigeration compressor, illustrating a part of the stationary block-stator assembly having a helical suspension spring mounted according to the prior art and using a lower support means attached to the bottom portion of the compressor shell.
Figure 1A:
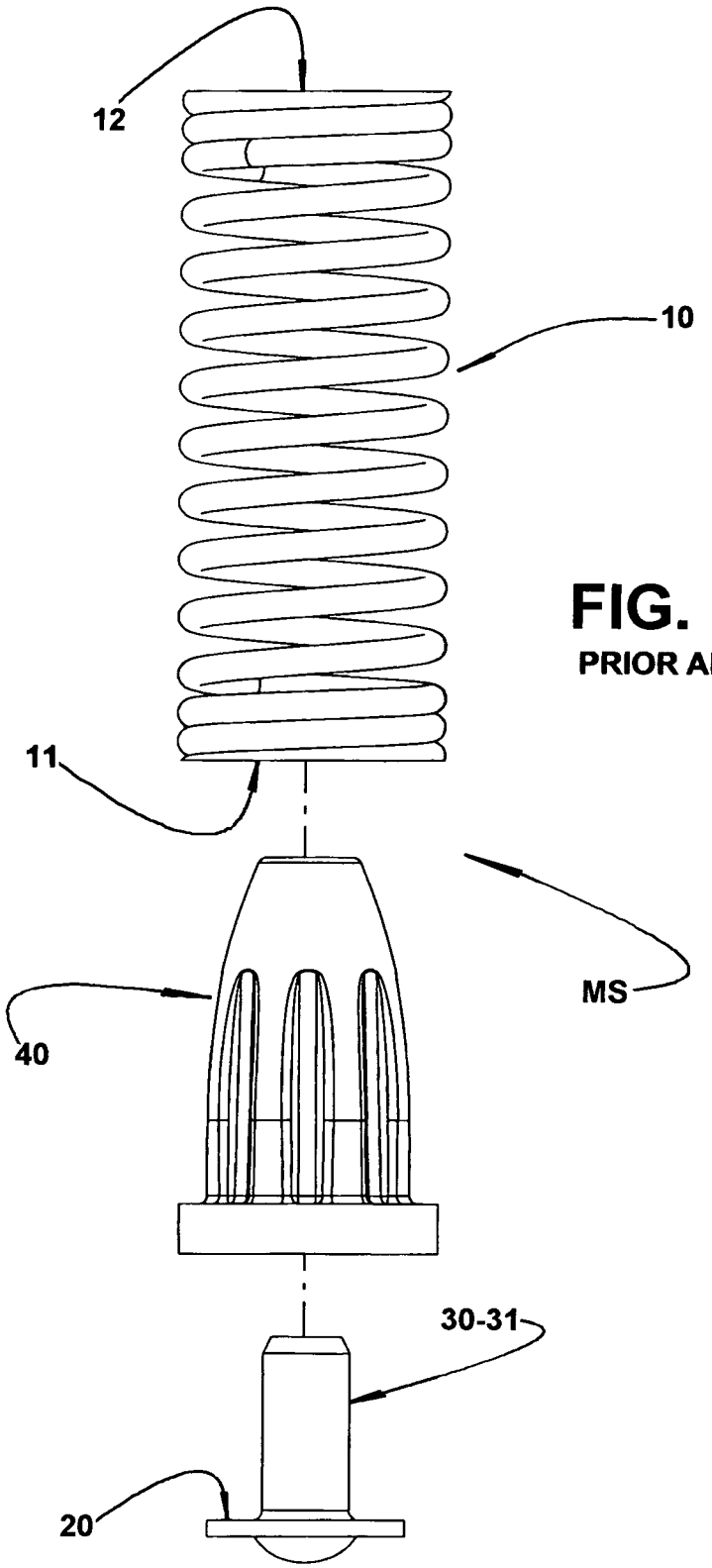
FIG. 1A PRIOR ART
FIG. 1A represents an exploded side view of a helical spring and the elements constitutive of the lower support means illustrated in FIG. 1.
Figure 1B:
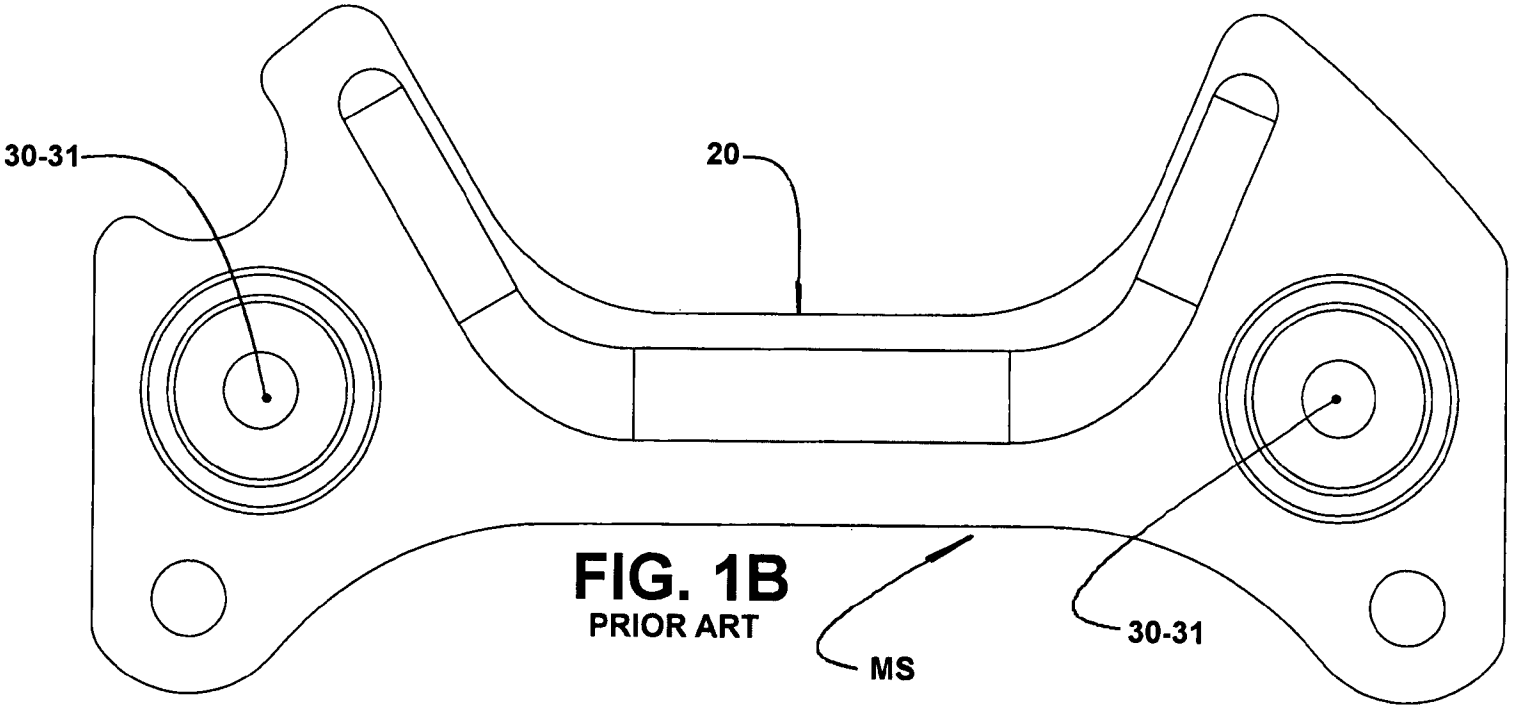
FIG. 1B PRIOR ART
FIG. 1B represents a lower plan view of the base plate of the upper support means illustrated in FIG. 1.
Figure 1C:
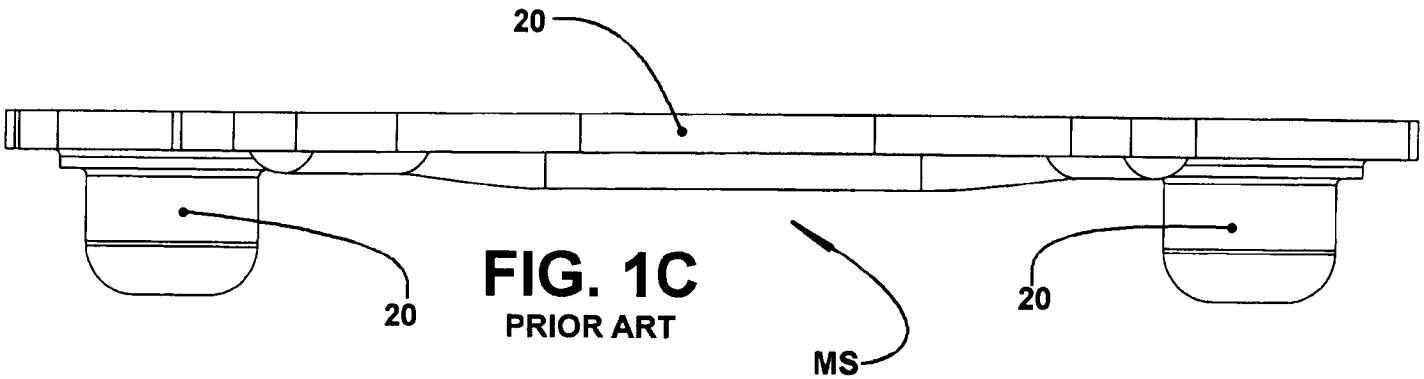
FIG. 1C PRIOR ART
FIG. 1C represents a side view of the base plate of the upper support means illustrated in FIGS. 1 and 1B.
Figure 2:
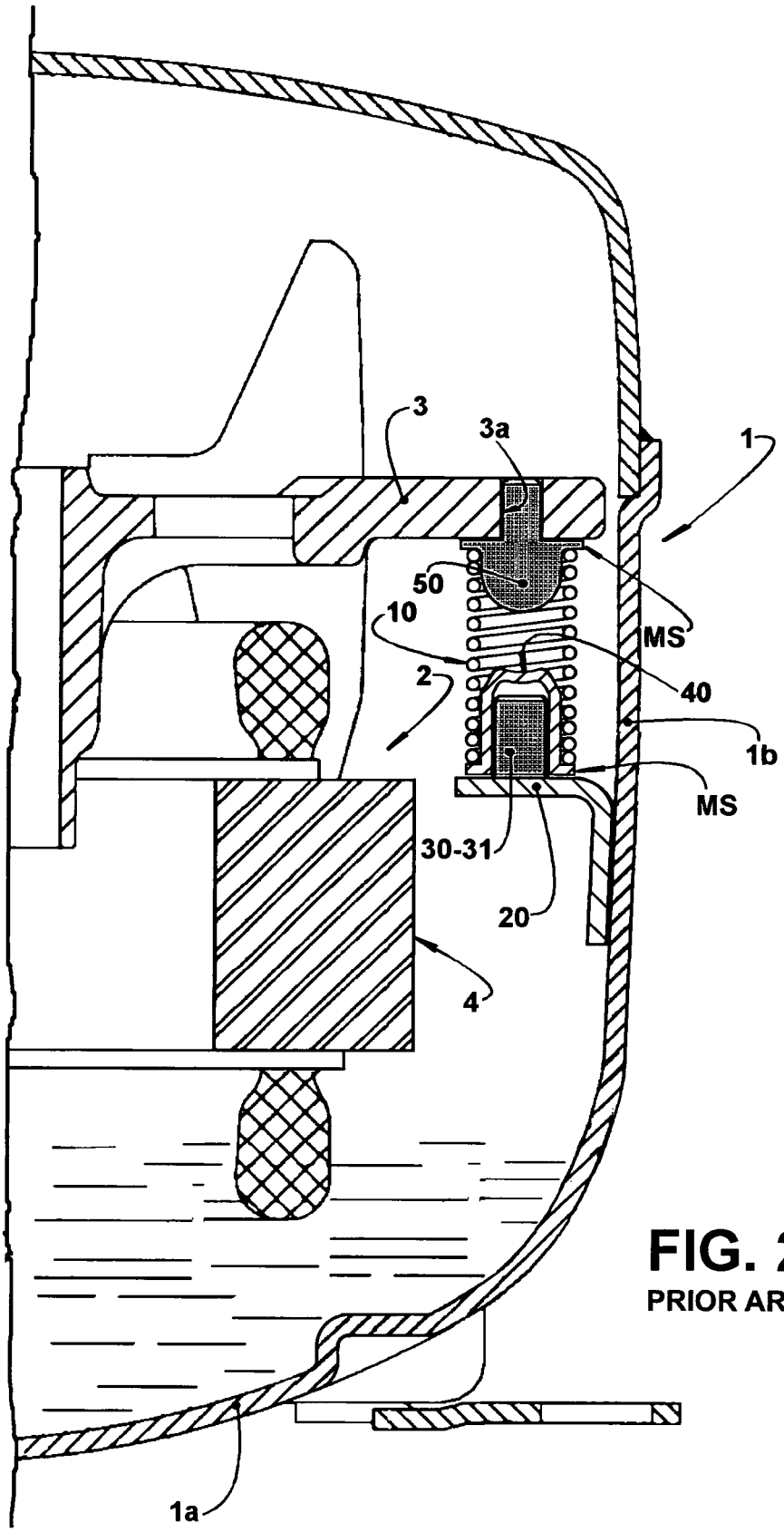
FIG. 2 PRIOR ART
FIG. 2 represents a schematic vertical sectional view of a portion of a refrigeration compressor, illustrating a part of the stationary block-stator assembly having a helical suspension spring mounted according to the prior art and using a lower support means attached to the lateral portion of the compressor shell.
Figure 2A:
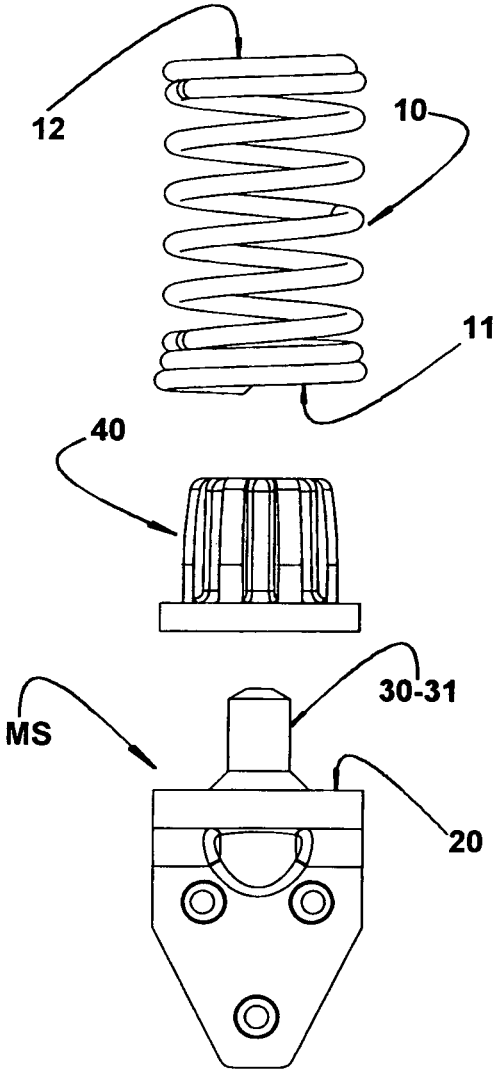
FIG. 2A PRIOR ART
FIG. 2A represents an exploded elevational front view of the assembly formed by a helical spring and the elements constitutive of the lower support means illustrated in FIG. 2.
Figure 2B:
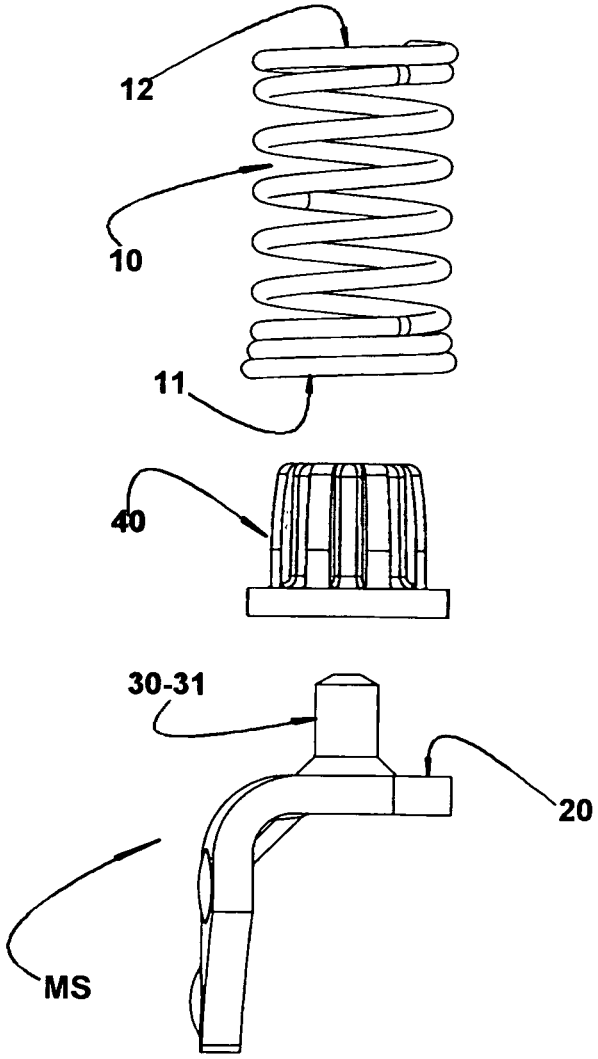
FIG. 2B PRIOR ART
FIG. 2B represents an exploded elevational side view of the assembly formed by a helical spring and the elements constitutive of the lower support means illustrated in FIGS. 2 and 2A.

As illustrated and already previously described, the present invention is applied to a refrigeration compressor of the type having a vertical shaft type and comprising, as illustrated in FIGS. 1, 2, 6 and 7, a stationary assembly 2 formed by a block 3 to which is affixed a stator 4 of an electric motor of the compressor. The stationary assembly 2 is mounted in the interior of a shell 1 by means of a suspension system including helical springs 10 working under compression, each spring presenting a lower end 11 and an upper end 12.

According to the present invention, each support means MS comprises a base plate 20 formed from a flat or substantially flat metal sheet, generally presenting only one thickness along its extension and incorporating, in a single piece, at least two retention tongues 21 obtained from a portion of said base plate 20 which is bent so as to project outwardly from the plane of said base plate 10, so that said retention tongues 21 can be tightly fitted in the interior of one of the fixation lower end 11 and the fixation upper end 12 of an adjacent helical spring 10. As illustrated in FIGS. 3 to 7, the base plate 20 can present different constructions, depending on the part of shell 1 or stationary assembly 2 to which it will be affixed.

Each retention tongue 21 presents a determined longitudinal extension, and the assembly of retention tongues 21 of each base plate 20 defines, along its longitudinal extension, a profile coincident with the profile of the inner contour of the adjacent end 11, 12 of a respective helical spring 10, allowing for a tight and reliable anchorage between said end of the respective helical spring 10 and the base plate 20.

It should also be noted that the retention tongues 21, formed in the metallic material of the base plate 20 and connected thereto by only one end, are elastically and angularly deformable in relation to the plane of the base plate 20, allowing for a better dimensional adjustment thereof to said tight fitting in the interior of the adjacent end 11, 12 of the helical spring 10.

Figure 6:
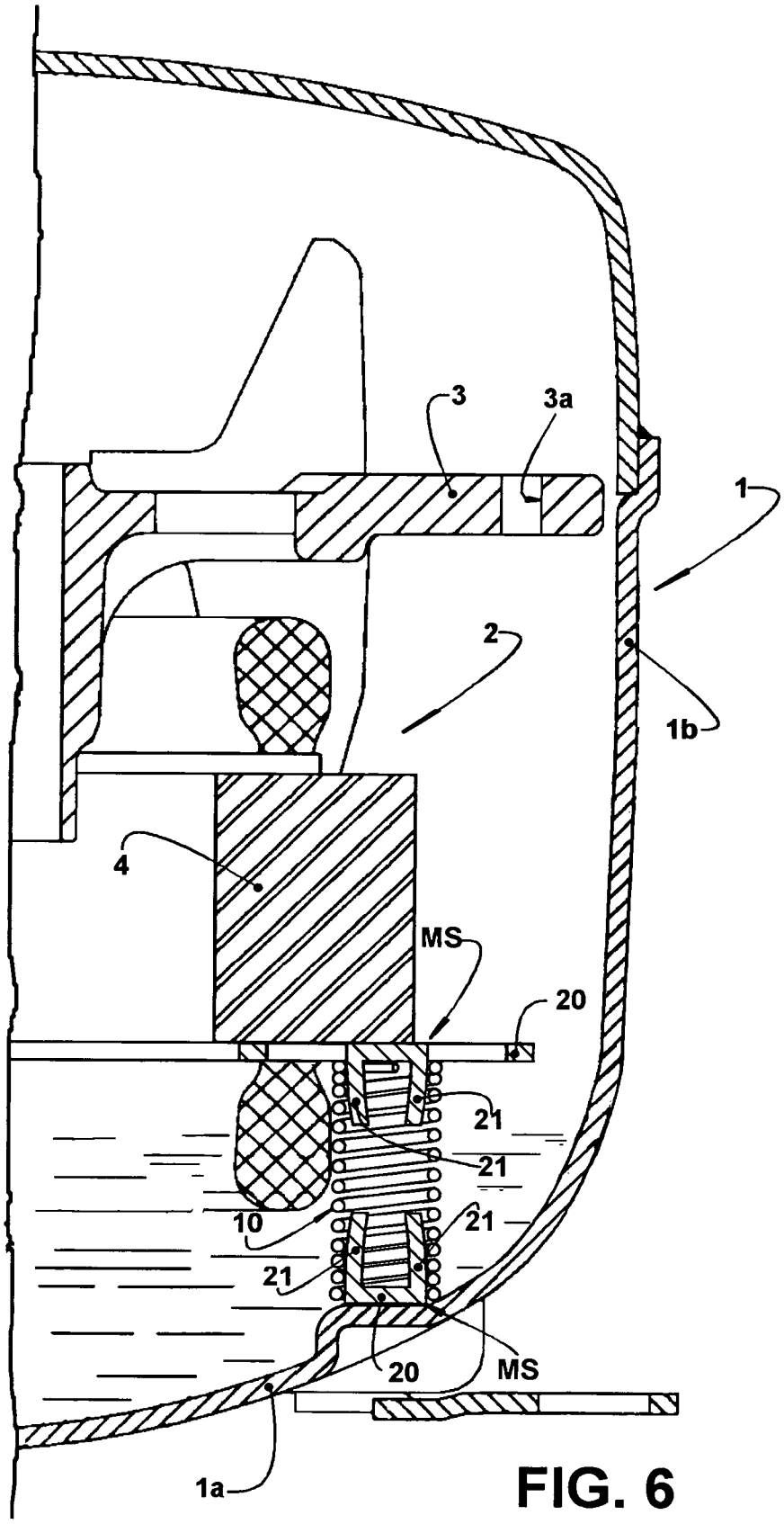
FIG. 6 represents a schematic vertical sectional view of a portion of a refrigeration compressor, illustrating a part of the stationary block-stator assembly having a helical suspension spring anchored to the support means constructed according to the present invention and illustrated in FIGS. 3, 3A and 4, 4A.
Figure 7:
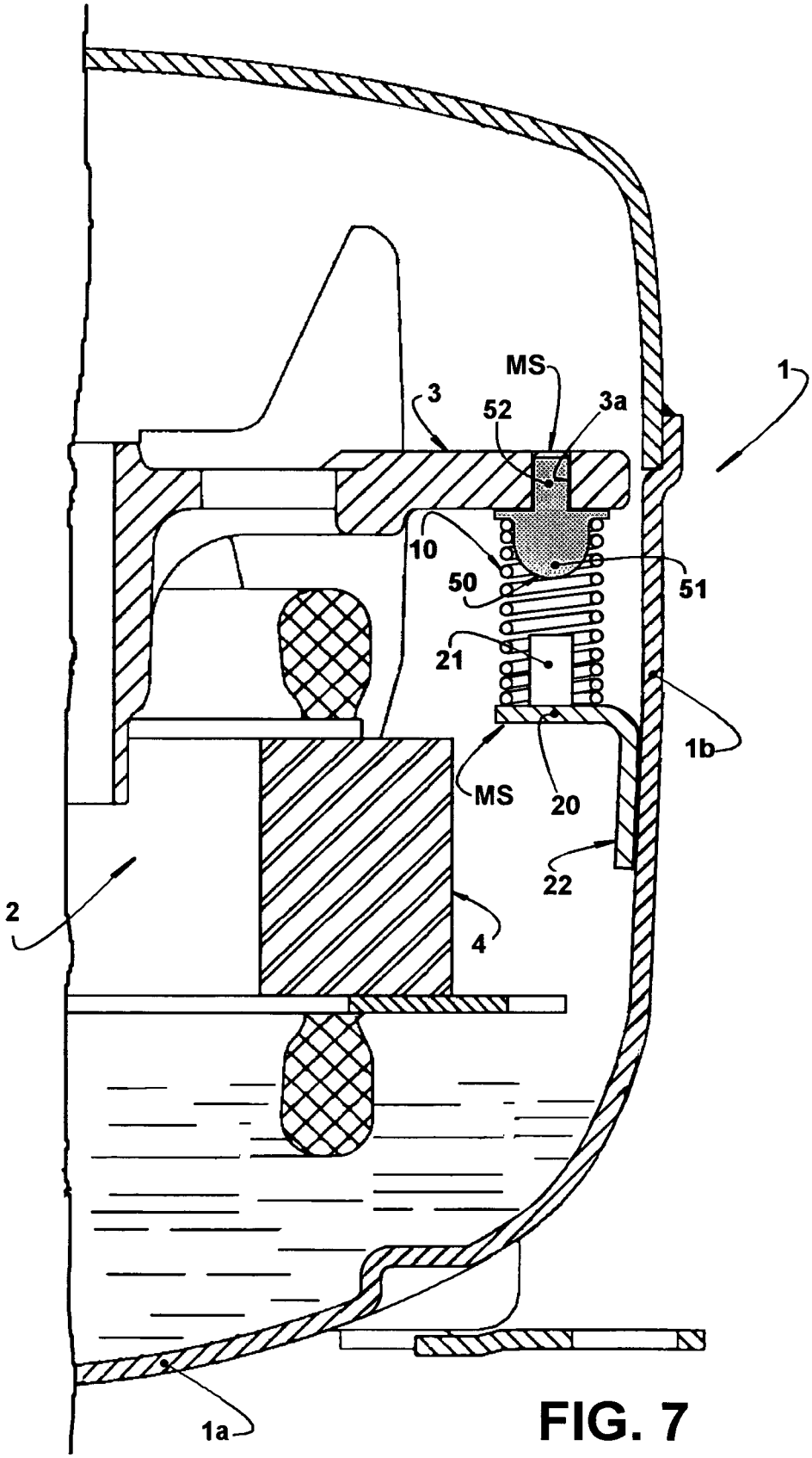
FIG. 7 represents a schematic vertical sectional view of a view similar to that of FIG. 6, but illustrating a lower support means of the invention attached to a lateral portion of the shell, and an upper support means of the prior art affixed under the block of the stationary assembly.

The retention tongues 21 can be constructed so that the contour of each of them defines, before being bent to the final operational position, an extension corresponding to the contour of the base plate 20, which is coplanar or not to the latter, forming a support means MS as illustrated in FIGS. 3, 3A and 4, 4A and as defined for the lower support means MS in FIGS. 6 and 7. In this construction, the retention tongues 21 present a thickness which can be equal, smaller or even larger than that of the base plate 20.

The retention tongues 21 can be defined by a respective portion of the base plate 20 that is cut out therefrom, said cut out portion being contained in the contour of the base plate 20. In the constructive form exemplified in FIGS. 5 and 5A, to be used close to the stator 4, as shown in FIG. 6, each retention tongue 21 is defined by a respective cut out median portion of the base plate 20 which is spaced back in relation to the contour of the latter. In these constructions in which the retention tongue 21 is originated from a portion that is cut out from the base plate 20, each retention tongue 21 presents a thickness that corresponds to the thickness of the respective cut out portion of the base plate 20. The cut out portions of the base plate 20 can be coplanar to the latter or previously deformed to present a non-coplanar position in relation to the remainder of the base plate 20.

Figure 5:
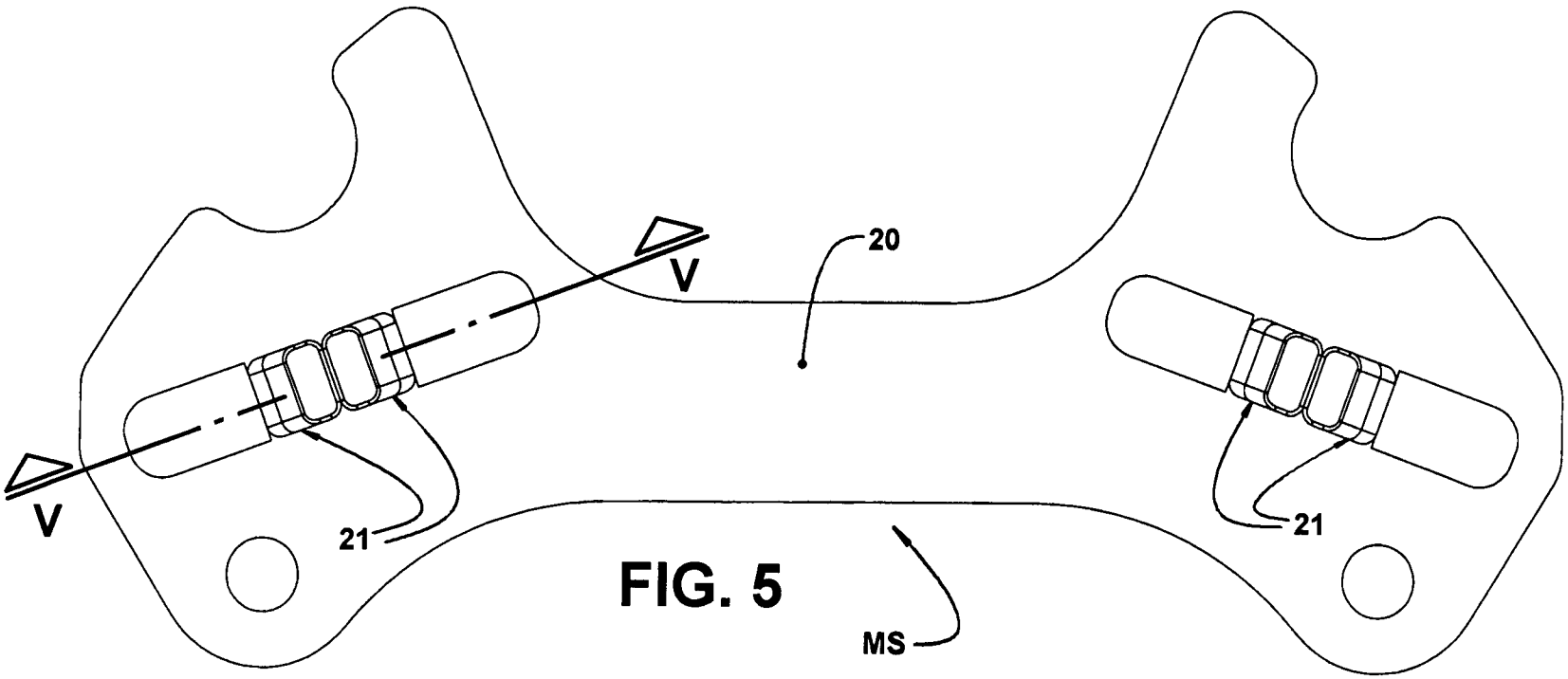
FIG. 5 represents a lower plan view of the base plate of an upper support means constructed according to the present invention and to be used for anchoring the upper end of a helical spring, whose lower end is anchored to a support means attached to the bottom portion of the compressor shell.
Figure 5A:
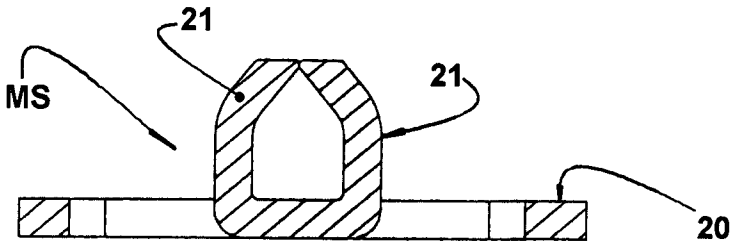
FIG. 5A represents a cross-sectional view of the base plate of the upper support means, said section taken according to line V-V in FIG. 5.

In the construction illustrated in FIGS. 5 and 5A, the retention tongues 21 are obtained from median portions that are cut out from the base plate 20 and spaced from each other. However, it should be considered the possibility of the retention tongues 21 of each support means MS being obtained by median portions cut out from the base plate 20, adjacent to each other, that is, forming a single "window" in the base plate 20.

Figures 3, 3A, 4, 4A:
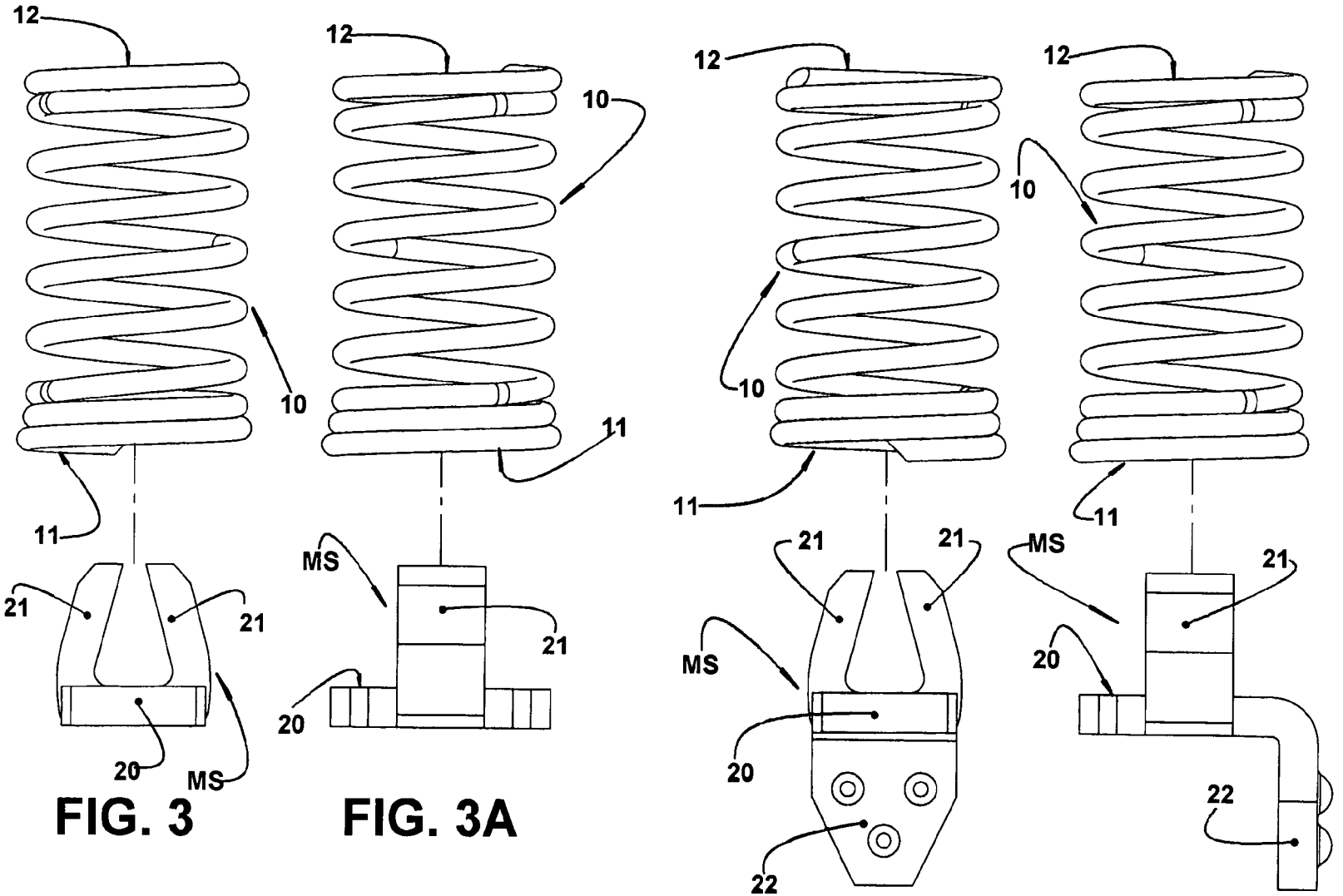
FIG. 3 represents an exploded elevational side view of the assembly formed by a helical spring and the elements constitutive of a lower support means constructed according to the present invention and to be attached to a bottom portion of the compressor shell.
FIG. 3A represents an exploded elevational front view of the assembly formed by a helical spring and the elements constitutive of the lower support means illustrated in FIG. 3.
FIG. 4 represents an exploded elevational front view of the assembly formed by a helical spring and the elements constitutive of a lower support means constructed according to the present invention and to be attached to a lateral portion of the compressor shell.
FIG. 4A represents an exploded elevational side view of the assembly formed by a helical spring and the elements constitutive of the lower support means illustrated in FIG. 4.

In the mounting condition of the invention illustrated in FIGS. 3 and 3A and applied to the lower support means MS of FIG. 6, each helical spring 10 has its lower end 11 anchored to a support means MS attached to a bottom portion 1*a* of the shell 1 of the compressor. In the mounting condition illustrated in FIG. 6 using the support means MS of FIGS. 3 and 3A, the upper end 12 of each helical spring 10 is anchored to a support means MS attached under the stator 4 of the electric motor.

The lower support means MS of the construction of FIGS. 3 and 3A comprises a base plate 20, which is formed from a flat or substantially flat metal sheet and incorporating, in a single piece, at least two retention tongues 21, each tongue having its contour defining, before being bent outwards from the plane of the base plate 20, a corresponding extension of the contour of the latter. Thus, in this type of construction, the retention tongues 21 are not obtained through cut out portions of the median regions of the base plate 20. In this construction, the retention tongues 21 are part of the contour of said base plate 20, before its bending to the final operational position.

In like manner, the upper support means MS of the construction of FIGS. 5 and 5A further comprises a base plate 20 formed from a flat or substantially flat metal sheet and incorporating, in a single piece, at least two retention tongues 21 obtained from a portion of said base plate 20 which is bent to project outwardly from the plane of the latter.

Nevertheless, considering a mounting arrangement for the upper support means MS of FIGS. 5 and 5A, as illustrated in FIG. 6, it is not necessary for the base plate 20 to be constructed such as the base plate 20 of FIGS. 3 and 3A, to be attached to the bottom portion 1*a* of the shell 1. In the mounting arrangement of FIG. 6, the upper support means MS has its base plate 20 attached directly under the lamination block of the stator 4. In this case, the base plate 20 can be constructed with a larger contour, allowing that the same base plate 20 incorporates, in a single piece, two assemblies of retention tongues 21, said assemblies being spaced from each other and each being positioned and projected to be fitted in the interior of the adjacent upper end 12 of a respective helical spring 10.

In the type of mounting arrangement illustrated in FIG. 7, each lower support means MS constructed as illustrated in FIGS. 4 and 4A has its base plate 20 attached to a lateral portion 1*b* of the shell 1 and the base plate 20 of each upper support means MS is attached to the stationary assembly 2 of the compressor, more specifically, in a portion of the stator 4.

In the construction for the lower support means MS illustrated in FIGS. 4, 4A and 7, the base plate 20 incorporates, in a single piece, the same retention tongues 21 described regarding the construction of support means MS illustrated in FIGS. 3 and 3A. However, the base plate 20 further incorporates, in a single piece, a lower flange 22 angularly disposed in relation to the base plate 20, so that it can be seated and affixed, by welding or any other adequate means, internally against the lateral portion 1*b* of the shell 1. In this case, it is possible that one of the retention tongues 21 defines, originally, a portion of the contour of the base plate 20 before its bending, whilst the other retention tongue 21 can be obtained through a cut out portion of the junction region between the base plate 20 and the lower flange 22.

In the mounting arrangement of FIG. 7, the construction of the upper support means MS is made so that it can be affixed to the block 3 of the stationary assembly 2. In the illustrated embodiment, said upper support means MS takes the form of an insert 50, which is constructed in metallic or synthetic material, presenting a head 51 configured to be simultaneously fitted in the upper end 12 of the respective helical spring 10 and seated against the block 3. The insert 50 further incorporates a rod portion 52 to be tightly fitted and affixed in the interior of a respective housing 3*a* provided in the block 3.

It should be understood that the insert 50 can be substituted by a projection incorporated, in a single piece, to the block 3 and dimensioned to be tightly fitted in the interior of the adjacent end 12 of the helical spring 10.

The invention claimed is:

1. A mounting arrangement of suspension springs in a refrigeration compressor of a type which comprises a shell (1) and a block (3) forming, with a stator (4) of an electric motor, a stationary assembly (2) which is mounted in an interior of the shell (1) by means of a suspension including an assembly of helical springs (10), each spring presenting a lower end (11) and an upper end (12), each said end (11, 12) being coupled, respectively, to an adjacent part of the shell (1) and the stationary assembly (2) through a support means (MS), wherein the support means (MS) comprises a base plate (20) incorporating, in a single piece, at least two retention tongues (21) obtained from a portion of said base plate (20) which is bent to project outwardly from the plane of said base plate (20), so that said retention tongues (21) can be tightly fitted in the interior of one of the ends (11, 12) of an adjacent helical spring (10).

2. The mounting arrangement, as set forth in claim 1, wherein the retention tongues (21) present, along their longitudinal extension, a profile coincident with the profile of the inner contour of the adjacent end (11, 12) of the helical spring (10).

3. The mounting arrangement, as set forth in claim 1, wherein the base plate (20) presents only one thickness along its extension.

4. The mounting arrangement, as set forth in claim 1, wherein the contour of each retention tongue (21) defines, before the bending of the latter, a corresponding extension of the contour of the base plate (20).

5. The mounting arrangement, as set forth in claim 4, in which the shell (1) is provided with a bottom portion (1*a*), said arrangement wherein in that one of the ends (11, 12) of the helical springs (10) is fitted around the retention tongues (21) of a base plate (20) affixed in the bottom portion (1*a*) of the shell (1).

6. The mounting arrangement, as set forth in claim 1, wherein each retention tongue (21) is defined by a respective cut out portion of the base plate (20) contained in the contour of the latter.

7. The mounting arrangement, as set forth in claim 6, wherein each retention tongue (21) is defined by a respective cut out median portion of the base plate (20) that is spaced back in relation to the contour of the latter.

8. The mounting arrangement, as set forth in claim 7, wherein the cut out median portions are spaced from each other.

9. The mounting arrangement, as set forth in claim 1, wherein the retention tongue (21) presents a thickness corresponding to the thickness of the respective cut out portion of the base plate (20).

10. The mounting arrangement, as set forth in claim 1, wherein one of the ends (11, 12) of the helical springs (10) is fitted around the retention tongues (21) of a base plate (20) attached to the stationary assembly (2).

11. The mounting arrangement, as set forth in claim 10, wherein the base plate (20) comprises two spaced-apart assemblies of retention tongues (21), each assembly being fitted in the interior of the adjacent end (11, 12) of a helical spring (10).

* * * * *